US005685504A

United States Patent [19]

Schneider et al.

[11] Patent Number: 5,685,504

[45] Date of Patent: Nov. 11, 1997

[54] GUIDED PROJECTILE SYSTEM

[75] Inventors: Arthur J. Schneider; Kenneth R. Johnson; Henry August, all of Tucson, Ariz.; Douglas E. Elerath, Albuquerque; Paul D. Shubert, Sandia Park, both of N. Mex.

[73] Assignee: Hughes Missile Systems Company, Los Angeles, Calif.

[21] Appl. No.: 474,862

[22] Filed: Jun. 7, 1995

[51] Int. Cl.[6] ..... F41G 7/20

[52] U.S. Cl. ..... 244/3.11

[58] Field of Search ..... 244/3.11, 3.13, 244/3.15, 3.16, 3.17, 3.21, 3.22

[56] References Cited

U.S. PATENT DOCUMENTS

| | | | |
|---|---|---|---|
| 4,003,659 | 1/1977 | Conard et al. | 244/3.11 |
| 4,351,503 | 9/1982 | Drori | 244/3.21 |
| 4,408,734 | 10/1983 | Koreicho | 244/3.13 |
| 4,516,743 | 5/1985 | Sweeney et al. | 244/3.13 |
| 4,728,057 | 3/1988 | Dunne | 244/3.16 |
| 4,737,028 | 4/1988 | Smith | 244/3.13 |
| 4,750,688 | 6/1988 | Davies | 244/3.11 |
| 4,767,209 | 8/1988 | Johnson | 244/3.16 |
| 4,917,014 | 4/1990 | Loughry et al. | 102/201 |
| 5,348,249 | 9/1994 | Gallivan | 244/3.11 |
| 5,372,334 | 12/1994 | Cuadros | 244/3.11 |
| 5,478,028 | 12/1995 | Snyder | 244/3.11 |

*Primary Examiner*—Michael J. Carone
*Assistant Examiner*—Theresa M. Wesson
*Attorney, Agent, or Firm*—Charles D. Brown; Wanda K. Denson-Low

[57] ABSTRACT

A system for guiding the flight of a projectile to a target. The system comprises a tracking and guidance system, the projectile, and a projectile reference and control system that is part of the projectile. The tracking and guidance system includes a target tracker, a projectile tracker for providing a projectile-tracking laser beam, and a target designator for designating the target using a target-tracking laser beam, and for providing range data indicative of the range to the target. A processor is coupled to the target designator, the target tracker, and the projectile tracker for processing target and projectile return signals and target range signals to generate an actuator command signal that is transmitted by the projectile tracker using the projectile-tracking laser beam and that is used to alter the flight of the projectile. The projectile reference and control system includes an optical reference including polarized and unpolarized retroflectors for reflecting the projectile-tracking laser beam back to the projectile tracker, and a detector that is responsive to the projectile-tracking laser beam provided by the projectile tracker, for detecting the actuator command signal transmitted by the projectile tracker. A command operated actuator is coupled to the detector for processing the actuator command signal and for generating a trajectory modification signal that is used to alter the flight of the projectile. A divert assembly coupled to the command operated actuator for generating thrust that diverts the trajectory of the projectile in response to the trajectory modification signal.

16 Claims, 2 Drawing Sheets

Fig. 2
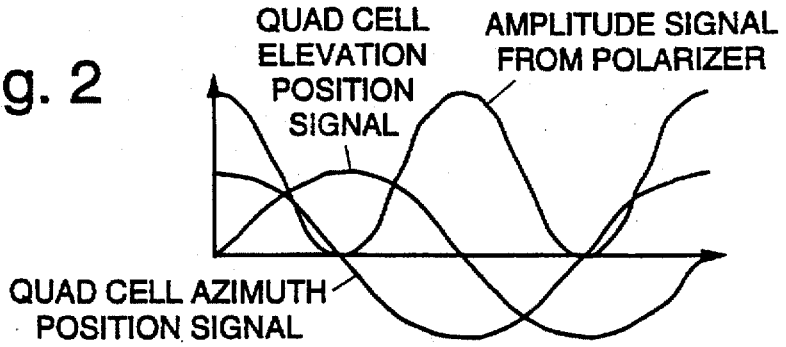
Fig. 3
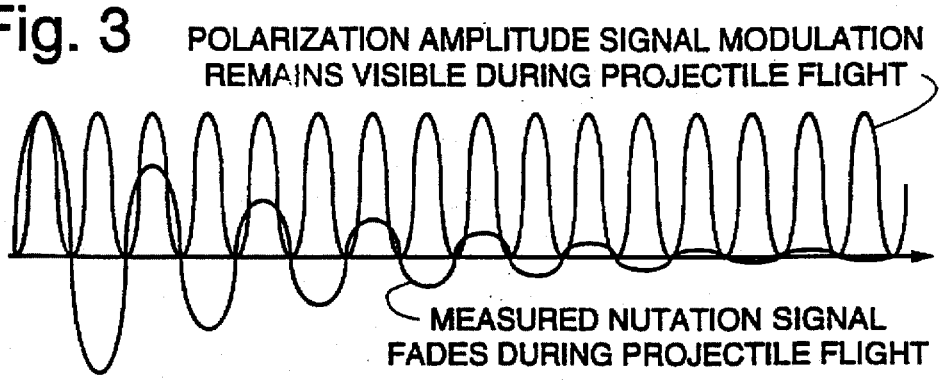
Fig. 4
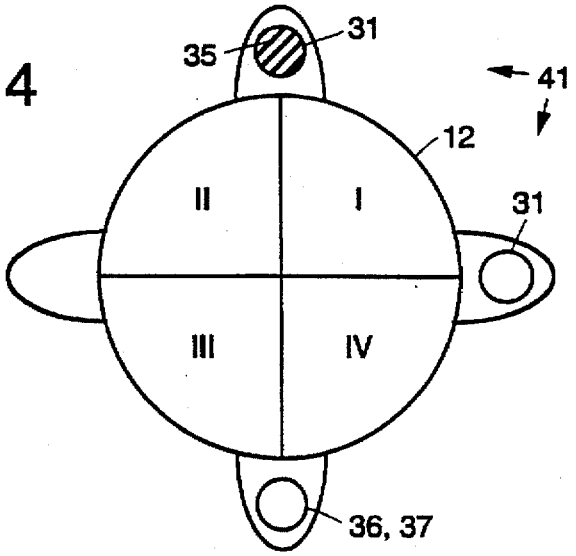
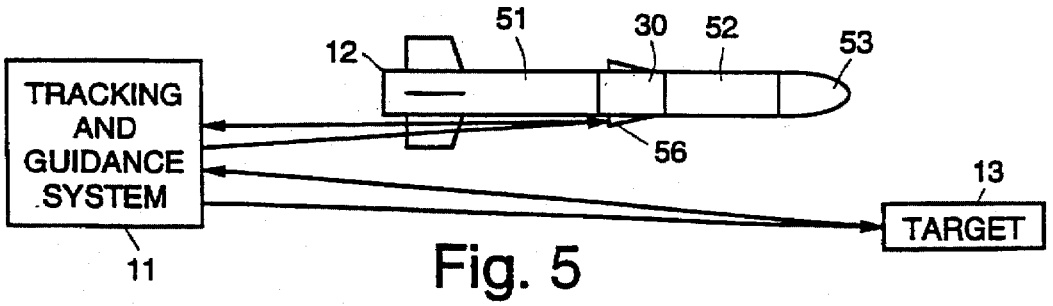
Fig. 5

GUIDED PROJECTILE SYSTEM

BACKGROUND

The present invention relates generally to guided projectiles, and more particularly, to a remote projectile guidance and control system requiring only command operated actuators on the guided projectile.

The known prior art relating to the present invention falls into two categories. The first category is that of autonomous guided weapons. These guided weapons contain control surfaces or thrusters, attitude sensors, optical and/or radar based target sensor(s), hardware and software to accomplish target tracking, and projectile control processors for making guidance computations. The Maverick, Stinger and Advanced Medium Range Air-To-Air Missile (AMRAAM) missiles fit into this category.

The second category is that of command guided missiles. The best known of this category is the TOW missile. The Tube-launched Optically tracked, Wire guided (TOW) missile uses a day/night electro-optical sensor to image a target for an operator who places a reticle on the target. The missile is tracked by a command unit that senses a beacon on the missile and commands the missile via a trailing wire to fly along the line of sight. The missile carries an attitude reference gyro to define body roll position and an aerodynamic tail control system.

In addition, a radar command system is used on the Patriot missile and several Soviet systems. These systems use attitude reference systems to cause commanded maneuvers to occur in the commanded direction.

Accordingly, it is an objective of the present invention to provide for a remote projectile guidance and control system requiring only command operated actuators on the guided projectile.

SUMMARY OF THE INVENTION

To meet the above and other objectives, the present invention provides for a system for guiding the flight of a projectile to a target. The system comprises a tracking and guidance system, a projectile, and a projectile reference and control system that is part of the projectile. The tracking and guidance system includes a target tracker, a projectile tracker for providing a projectile-tracking laser beam, and a target designator for designating the target using a target-tracking laser beam, and for providing range data indicative of the range to the target. A processor is coupled to the target designator, the target tracker, and the projectile tracker for processing target and projectile return signals and target range signals to generate an actuator command signal that is transmitted by the projectile tracker using the projectile-tracking laser beam and that is used to alter the flight of the projectile.

The projectile reference and control system includes an optical reference including polarized and unpolarized retroflectors for reflecting the projectile-tracking laser beam back to the projectile tracker, and a detector that is responsive to the projectile-tracking laser beam provided by the projectile tracker, for detecting the actuator command signal transmitted by the projectile tracker. A command operated actuator is coupled to the detector for processing the actuator command signal and for generating a trajectory modification signal that is used to alter the flight of the projectile. A divert assembly coupled to the command operated actuator for generating thrust that diverts the trajectory of the projectile in response to the trajectory modification signal.

The guidance system is not mounted on the projectile and no physical connection (such as a fiber optic link or wire) is required therebetween. The guidance system may be located on the ground or on a projectile launch platform such as a helicopter, or a rifle, for example. The guidance unit performs all target tracking and guidance functions except actual diversion of the projectile. The projectile incorporates no attitude sensors or seekers, or the like, and does not require target designation by laser, radar, or other active systems. The only guidance related component on the projectile is the guidance actuator, such as a lateral thruster or actuated fins, that is capable of responding to an externally generated command derived from the retroreflector and detector that remains within the visible line of sight of the guidance unit throughout the controlled portion of the flight of the projectile.

By removing the need for projectile-mounted attitude control sensors, and seekers, and the like, the complexity and cost of the projectile is minimized, and overall system costs are dramatically reduced. The present invention allows retrofit of a guidance and control system into otherwise ballistic projectiles at minimum cost. The present invention allows the guided projectiles to be very small, and in particular provides for a guided bullet.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 2 shows superposition of roll measurements made by the system of FIG. 1;

FIG. 3 shows that use of a nutating return allows unambiguous determination of up and down, and thus calibration of polarized returns generated by the system of FIG. 1;

FIG. 4 shows a rear view of a projectile employed in the system of FIG. 1; and FIG. 5 shows a rocket embodiment of the present invention.

DETAILED DESCRIPTION

Figure 1:
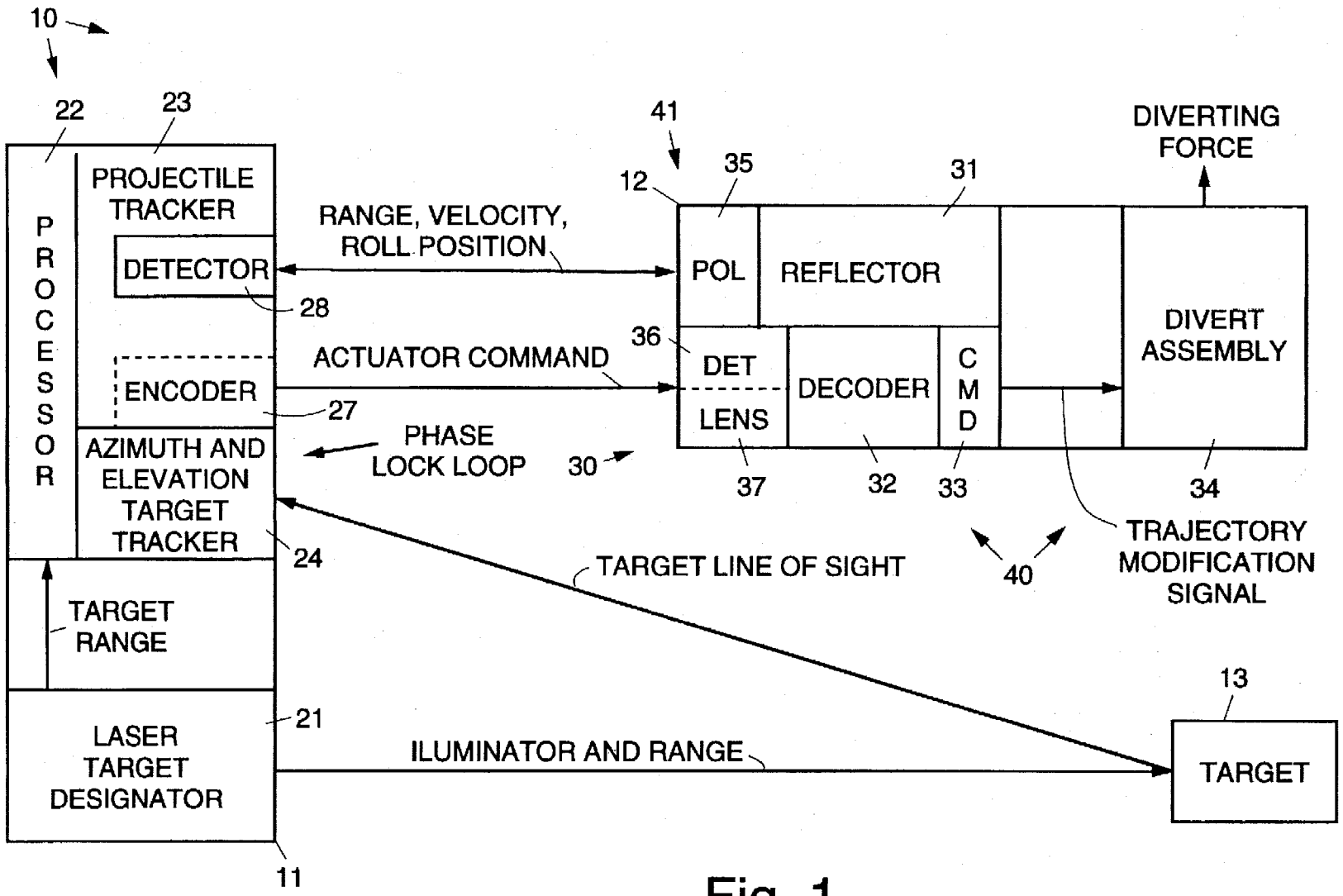
FIG. 1 shows a block diagram of a system for guiding and controlling the flight of a projectile in accordance with the principles of the present invention.

The present invention is described below in the context of a spin stabilized projectile 12, such as a bullet or rocket, for example. Extensions to the present invention to use with an aerodynamically stabilized projectile 12 and other alternative configurations are also described.

Referring to the drawing figures, FIG. 1 shows a block diagram of a guided projectile system 10 for guiding and controlling the flight of the projectile 12 in accordance with the principles of the present invention. The system 10 is comprised of two physically separate subsystems 11, 30. The first subsystem 11 is hereinafter referred to as a tracking and guidance system 11. The tracking and guidance system 11 may be disposed on the ground, on a projectile launch platform such as a helicopter, for example, or other vehicle. The tracking and guidance system 11 comprises a target tracker 24 and an optical, laser-based, projectile tracker 23. The target tracker 24 may comprise an imaging tracker or a laser designator return signal tracker, for example. The projectile tracker 23 may employ a high repetition rate pulsed laser illuminator or an amplitude modulated CW laser, for example.

A guidance and control processing subsystem including a target acquisition designation sight or laser target designator 21 and a processor 22 are used to designate the target 13. The processor 22 is coupled to the target designator 21, the target tracker 24, and the projectile tracker 23 and processes target and projecthe return signals and target range signals to generate an actuator command signal or signals that is used to control the flight of the projectile 12, as will be described below.

The second subsystem 30 is hereinafter referred to as a projectile reference and control system 30. The projectile reference and control system 30 is mounted on or disposed in the projectile 12 that is to be controlled. The projectile reference and control system 30 comprises an optical reference 41 including one or more retroflectors 31 and a polarizer (POL) 35 disposed in front of one retroreflector 31, that are used in conjunction with the projectile tracker 23 to track the projectile 12. The projectile reference and control system 30 further comprises a detector (DET) 36 that is sensitive at the optical tracking wavelength of the projectile tracker 23 or at a nearby wavelength, and a command operated actuator subsystem 40 comprising an optional decoder 32 coupled to the detector 36, a command processor (CMD) 33 coupled to the detector 36 or decoder 32, as the case may be, and a divert assembly 34 coupled to the command processor 33 that diverts the trajectory of the projectile 12 in response to a trajectory modification signal provided by the command processor 33. The trajectory modification signal is generated in response to the actuator command transmitted from the tracking and guidance system 11.

For a spin stabilized projectile, the system 10 operates as follows. Initially, the target 13 is acquired using the target tracker 24. Acquisition is accomplished using either the imaging tracker or laser designator return signal tracker. Range to the target 13 must also be known or measured, and is typically provided as an output from the laser target designator 21. The projectile 12 is then launched (fired) at the target 13 using the best available target data.

Next, the projectile tracking and guidance system 11 is actuated. The tracking and guidance system 11 acquires the projectile 12 shortly after the projectile 12 has been launched (fired), and tracks the projectile 12 as the projectile 12 travels towards the target 13. This braking is performed by actively illuminating the projectile 12 with a linearly polarized laser beam provided by the projectile tracker 23, observing the return from the polarized and unpolarized retroflectors 31, and controlling the pointing of the laser beam so that it remains locked on the projectile 12.

Next, the projectile tracking and guidance system 11 measures the trajectory and roll orientation of the projectile 12. The projectile tracker 23 measures the range to the projectile 12 and determines the angular location of the projectile 12 relative to the location of the target 13 as measured by the target tracker 24. The range measurement is easily accomplished with the projectile tracker 23 by using either the high repetition rate pulsed laser illuminator or the amplitude modulated CW laser. Since amplitude modulation of the laser beam is under the direct control of the projectile tracking and guidance system 11, the return from the retroreflectors 31 may be synchronously demodulated to maintain a high signal noise ratio. The angular location of the projectile 12 relative to the target 13 is determined by optically referencing the two tracking measurements derived from the target tracker 24 and the projectile tracker 23.

The projectile tracking and guidance system 11 also measures the roll orientation of the projectile 12. The ability to measure the roll orientation is one of the key enabling features of the guided projectile system 10. The optical reference 41 is mounted on the projectile 12 so that it is visible to the projectile tracker 23 throughout the guided portion of the projectile's flight. In the case of the spin stabilized projectile 12, the optical reference 41 comprises the retroreflector 31 having the polarizer 35 disposed in front of it so that a polarized laser return signal is produced thereby. The optical reference 41 is mounted on the projectile 12 in such a manner that they nutate about the roll axis of the projectile 12, and this nutation is visible to the projectile tracker 23 during an initial portion of the projectile's flight. This is most easily accomplished by attaching the optical reference 41 off axis relative to the spinning projectile 12.

While the projectile 12 is near the projectile tracker 23, i.e. shortly after launch (firing), the nutation of the optical reference 41 is resolvable by a quadrant, or other similar detector 28, which is part of the projectile tracker 23 and which provides a tracking control error signal. When the projectile 12 is further from the projectile tracker 23, i.e. some time after launch (firing), the nutation of the optical reference 41 will no longer be observable. However, because the optical reference 41 is polarized (using the polarizer 35), modulation of the incident polarized beam from the projectile tracker 23 due to continued rotation of the projectile 12 allows continued measurement of its roll orientation.

The initial measurement of the nutation of the optical reference 41 is crucial in measuring the roll orientation of the projectile 12. This is because the return from the optical reference 41 is the same for a given roll orientation and one that is changed by 180 degrees. Essentially, the optical reference 41 cannot be used by itself to distinguish between up and down. This problem is solved by first observing the nutating return at short range and calibrating the polarization state of the modulated beam relative to this nutation. This is illustrated in FIGS. 2 and 3.

FIG. 2 shows superposition of roll measurements made by the system 10 described above. FIG. 2 shows that the nutating return allows unambiguous determination of up and down, and thus to calibrate the polarization return. FIG. 3 shows that as the projectile 12 moves away from the projectile tracker 23, the nutation becomes less observable very quickly due to losses in optical resolution, while the polarization measurement continues to be effective until it is limited by the available power in the reflected laser beam.

The processor 22 in the projectile tracking and guidance system 11 determines the corrections required to the then current trajectory of the projectile 12 in order for it to hit the target 13. Since the current trajectory, projectile specific guidance data (e.g. the mass of the projectile 12 and the impulse that is provided by the divert assembly 34) and the desired impact point are known, the processor 22 uses these data to determine the time and the direction to implement the trajectory correction. Since the roll orientation of the projectile 12 as a function of time is also known, the processor 22 is able to compute the exact time that a trajectory correction must he made.

The actuator command to the divert assembly 34 is uplinked to the projectile 12 using the laser tracking beam of the projectile tracker 23. Since the projectile tracker 23 tracks the projectile 12 with an illuminating laser beam, the beam also serves as a communication link to the projectile 12. In particular, the projectile tracking and guidance system 11 sends the actuator command signal to the projectile 12 via this link. The detector 36 in the projectile reference and control system 30 receives the actuator command signal. The detector 36 is sensitive at a wavelength which is near to, or the same as, the tracking laser wavelength used by the projectile tracker 23 and contains a minimal set of logic control elements that allow it to detect the actuator command signal. The actuator command signal may optionally be encoded by an optional encoder 27 to prevent countermeasures from interfering with proper operation and is decoded by the decoder 32 in this case.

The command operated actuator system 40 alters the trajectory of the projectile 12 based on the uplinked actuator command signal. The command subsystem effects the commanded redirection of the projectile 12 by sending a trajectory modification signal to the divert assembly 34 which provides a diverting force (or thrust) to the projective 12. Additional actuator command signal may also be generated and uplinked to actuate the divert assembly 34 or lateral divert thruster if a large trajectory diversion is required.

The detector 36, command subsystem and divert assembly 34 may be very simple and compact. For example, in a guided bullet 12 application, the detector 36 may be a photodiode filtered so that it is sensitive to a command wavelength that is near the tracking wavelength. The uplinked actuator command signal may be a pulse of energy at the command wavelength. The photodiode may be made to conduct and ignite a lateral divert thruster in the projectile 12. Thus the projectile 12 may be made very small.

An alternative means for igniting the divert assembly 34 is to use laser energy to directly ignite powder in the thruster 34, for example. A gradient index lens 37 (FIG. 1) may be used to focus a high energy laser pulse collected by the lens onto igniter powder disposed adjacent an inner end of the lens. Direct laser ignition has the advantages that it is simple and also eliminates time delays.

The description above assumes a rotating projectile 12. In the case of an aerodynamically stabilized projectile 12 or other nonrotating projectile 12, the following modifications to the above system 10 may be made to implement the present invention. First, because the optical reference 41 on the nonrotating projectile 12 does not nutate, a modification is needed to calibrate the polarized retroreflected return from the projectile 12. This may be achieved in a variety of ways, all of which require an additional, distinct, optically resolvable feature disposed on the projectile 12 that is visible to the projectile tracker 23. For example, a second retroreflector 31 responsive at a second laser wavelength and located away from the polarized retroreflector 31 provides this feature. A second coaligned illuminating laser in the projectile tracker 23 at the appropriate wavelength may then be used to determine the roll orientation of the projectile 12 and thus calibrate the polarized return. The optical reference 41 does not rotate, but that is easily accommodated by rotating the polarization of the illuminating laser beam. Thus the present system 10 may be used both roll and aerodynamically stabilized projectiles 12.

Presented below is a more detailed discussion of certain aspects of the present system 10 and specific examples are described. At long ranges there are several factors that contribute to an unacceptable miss distance for the projectile 12. Among these are initial aiming error, heavy cross winds, and acceleration of the target 13 while the projectile 12 is in flight. If the range is 2000 meters and the time of flight is three seconds, there is opportunity for significant errors with a small projectile 12 having about 0.50 inch caliber.

The projectile guidance system 10 may be used with a simple low cost expendable projectile 12, such as a bullet, and the tracking and guidance system 11 continuously observes the target 13 and the projectile 12, and commands the projectile 12 to change its trajectory as it approaches the target 13 so it impacts the target 13. To accomplish this, the normal ballistic trajectory of the projectile 12 is tracked, and the error between this trajectory and the optimal trajectory is monitored, and a predetermined angular change is made to the path of the projectile 12 at a range that redirects the projectile 12 at the target 13. Utilizing the normal ballistic trajectory requires the addition of a minimal amount of energy for path correction. This energy is much less than that required to fly a straight line-of-sight path.

A predetermined angular offset to the path of the projectile 12 is achieved using a fixed propellant charge, for example, fired perpendicular to the body of the projectile 12. A lateral velocity change of 150 feet per second may be attained with a weight of propellant of about 1/32 of the weight of the projectile 12. The charge is fired in response to the actuator command signal (a laser pulse) from the projectile tracker 23 located at the launch vehicle, timed at the correct range relative to the target 13. The laser energy may be used to dose a switch that fires a solid state RC spark gap circuit in the command system 33 to ignite the propellant in the divert assembly 34 (thruster). The capacitor in the spark gap circuit may be charged just to firing (launch) or by the acceleration of the projectile 12.

Referring to FIG. 4, it shows a rear view of a typical projectile 12 employed in the present system 10. The projectile 12 is shown having the retroflectors 31, the polarizer 35 disposed over one retroreflector 31, and the detector 36 mounted to a rear surface of the projectile 12. However, it is to be understood that the specific arrangement shown in FIG. 4 is representative of only one of many arrangements for the optical components used on the projectile 12, and these may be disposed as the application and configuration of the projectile 12 permits.

The projectile 12 spins at a normal spin rate. In addition to measuring the range to the projectile 12, the tracking and guidance system 11 continuously measures the angular position of the projectile 12 about its axis, in order to divert the flight path of the projectile 12 in the correct direction. This is accomplished using the optical reference 41 on the projectile 12. If the reflected energy is polarized, it has two peak values and two zero values per revolution. This is illustrated in FIG. 2. The zeros provide the most accurate measure of angular position time constant spin speed. However, there is a 180 degree ambiguity in position that can be resolved by observing the offset retroreflector at short range, and keeping track of the zeros until the path adjustment takes place. At that range, the pattern on the base of the projectile 12 cannot be observed, but the variations in reflected polarized energy can.

The system 10 provides a circular error probability of one half foot at a range of 6000 feet, requiring a resolution of at least 0.08 milliradians. To achieve day and night performance, an infrared focal plane array detector is used. Two are currently available for this application, including a 256×256 VSMIR InSb detector and a 640×480 Pt-Pt-Si detector. Both detectors are sensitive at 1.5 microns to laser reflections. At the desired resolution, the field of view for 256 pixels is 20.5 milliradians, for 480 pixels is 38 milliradians and for 640 pixels is 51 milliradians. The 20.5 milliradian field of view is too small for target search and acquisition, so a dual field of view is required. The 51 milliradian field of view is marginal for target acquisition. Either a larger focal plane array detector is required or dual field of view optics are required.

As an example, the velocity of the projectile 12 may be 3000 feet per second. The lateral thruster may induce a velocity of 300 feet per second, changing the path direction by 100 milliradians. If the error were 30 feet at the plane of the target 13, the lateral charge would be fired at 300 feet to go. Measuring the spin angle and firing the divert assembly 34 (lateral thruster) must be precise. A one half foot miss distance from an offset error of 30 feet demands a thrust direction accuracy of 17 milliradians. If the projectile 12 rotates at 2500 revolutions per second the time for a half rotation between zero returns from the polarized reflector is 200 microseconds. The time to fire can easily be measured to a microsecond. The delay for laser propagation to 6000 foot range is 6 microseconds. The propellant may be a quick reacting energetic primer, but the ignition time remains to be measured. The time constant of the capacitor spark gap igniter can be adjusted to less than a microsecond.

Charging the capacitor may be accomplished in a variety of ways. The acceleration of the fired projectile 12 can actuate a piezoelectric crystal delivering energy to the capacitor. The heat generated by the propellant may be used to actuate a pyroelectric device, or an inductive charger may be provided as part of the launcher and transmit energy to the projectile 12 as it emerges from the barrel of the launcher.

The system 10 can achieve an accuracy of 6 inches at a range of 6000 feet. The accuracy degrades linearly with increasing range, and may readily be extended to 12000 feet or the dynamic range of the projectile 12. Extending the range greatly improves the utility of the projectile 12. This present invention may be extended to a two stage projectile 12 with good accuracy and an explosive charge with a fly-over/fire down capability. This projectile 12 may be used to hit personnel hiding behind sandbags or around corners. The expendable projectile 12 is simple and low cost. The system 10 has unlimited reusability within component life. The reduced-to-practice embodiment of the projectile 12 described herein is 0.50 inches in diameter. The principles described herein may be applied to smaller and larger projectiles 12 of from 9 to 120 millimeters in diameter, for example.

The present system 10 may be adapted for use with projectiles 12 such as existing rockets, such as a Hydra 70 rocket, for example, which is launched from a helicopter, for example. This embodiment is illustrated in FIG. 5. The projectile reference and control system 30 used in the rocket is depicted in FIG. 4. The Hydra 70 rocket 12 has a rocket motor 51, a warhead 52, and a fuze 53 and is deployed from a lightweight launcher. The present system 10 is implemented with the Hydra 70 rocket without modifying its components, minimizing the amount of hardware that must be expended with each fired rocket, and maximizing the use of existing components including launcher, and laser target designator 21 employed in the projectile tracking and guidance system 11. The existing Hydra 70 rocket and warhead 52 and the existing laser target designator 21 are used, and a new rocket control module 30 that comprises projectile reference and control system 30 is disposed between the rocket motor 51 and warhead 52, and a new command guidance module that comprises the projectile tracking and guidance system 11 that mounts to an unmodified launcher.

The system 10 uses the laser target designator 21 to illuminate the target 13. The command guidance module contains the projectile tracker 23 and target tracker 24. The projectile tracker 23 uses a diverging CW laser beam to illuminate the rocket which is augmented with polarized retroreflectors 31 mounted on rear surfaces of canards 56 of the rocket control module 30, and the detector 36 that is used to pulse command the rocket trajectory correction.

The projectile tracker 23 may be used to guide a single rocket 12 or simultaneously guide multiple rockets to a single target 13. Multiple rocket guidance may be accomplished with the addition of multiple command guidance modules 30, one for each rocket that is to be guided. The system 10 may be adapted to time-share the projectile tracker 23 to guide several rockets fired in rapid succession.

Helicopter crew engagement procedures are identical to current procedures for firing Hydra 70 rockets with the exception of additionally using standard procedures to laser designate the target 13 prior to firing. The target 13 is designated using the laser target designator 21 on the helicopter. To engage a target 13 the crew selects the present system 10, the laser target designator 21 is used to designate the target 13. The target tracker 24 searches for and locks on to the designated target 13. The target tracker 24 sends range information to the processor 22 (FIG. 1).

As the rocket is fired the laser tracker is turned on and a polarized CW laser beam is pointed at the rocket 12. At the end of rocket motor 51 boost, the canards 56 on the rocket control module 30 deploy to reveal linearly polarized and nonpolarized retroreflector 31 mounted on the rear surface of two of the canards 56. At motor burnout, the rocket passes through a known position allowing the projectile tracker 23 to acquire and lock onto the retroreflectors 31. Acquisition is accomplished by diverging the beam to illuminate the rocket and, after acquisition, precise tracking is performed by focusing the beam so that it remains locked onto the retroreflectors 31 throughout its flight to maintain precise angle track accuracy. Focusing of the beam also ensures sufficient power at maximum range to maintain lock-on. The broad acquisition laser beam is only on during the acquisition process.

Due to the offset location of the polarized retroreflector from the centerline of the rocket and the rotation of the rocket 12 (approximately 35 revolutions per second at motor burnout), two separate phenomena are observed by the laser tracker. The offset of the retroreflector 31 cause the position of the retroreflector 31 to nutate about the center of rotation of the rocket, and the polarizer 36 modulates the brightness of the return beam. As the range to the rocket increases, the nutation no longer is visible to the tracker 23 because the linear offset of the retroreflector 31 subtends a smaller angle as range increases until the angle track modulation diminishes. However, the polarization modulation of the return energy continues to be observable to maximum range. Therefore, the precise orientation of the rocket is continuously monitored using the nutation data to establish a baseline, and observation of the modulation of the return laser energy by the polarizer 36 to count rotations for the duration of the trajectory. Synchronization of a phase locked loop in the projectile tracker 23 is used to eliminate laser dropouts. The nutation phase is used to determine up from down. The precision angular reference is taken from the null caused by crossed polarizers.

The phase locked loop is used to track the roll position of the projectile 12 as it spins, and inputs to the phase locked loop at short range are signals that comprise the azimuth and elevation angle of the concentric polarizer 35 and reflector 31 and the variation in amplitude of the polarized return signal therefrom. At long range, inputs to the phase locked loop comprise only the polarized return signal. Continuous measurement of roll position resolves ambiguity of the polarized return by locking the phase lock loop to the roll angle of the projectile 12 at short range when nutation unambiguously defines roll position of the projectile 12.

A laboratory experiment was performed using a dill motor to spin a concentrically mounted retroreflector and a polarization filter. The spin rate was 20 Hz. A scribed line on the rotating trait correctly indicated rotation angle once per revolution. The tracking system correctly measured up from down, and the phase locked loop tracked actual position to an accuracy of 0.8 degrees.

During fly out the rocket tracker tracks and ranges the rocket while the laser target designator tracks the target 13. These data are combined with the vehicle inertial position to develop a trajectory inertial measurement for the rocket. This trajectory measurement includes initial pointing errors, individual aerodynamic effects, and rocket motor thrust variations, etc. Deviation of the measured trajectory's impact point projected at the target 13 is used to develop a tracking solution for the trajectory modification. At precisely the correct lime the command laser beam uplinks the actuator command to control the thrust provided by the divert assembly 34. Key to this process is the ability to continuously maintain knowledge of the roll orientation of the rocket and to uplink commands through the communication link provided by the laser beam of the projectile tracker 23 at the proper time to divert the rocket.

Thus, a remote projectile guidance and control system requiring only command operated actuators on the guided projectile has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A guided projectile system for guiding a projectile to a target, said system comprising:

a tracking and guidance system comprising:

a target tracker;

a projectile tracker for providing a projectile-tracking signal;

a target designator for designating the target using a target-tracking signal, and for providing range data indicative of the range to the target; and a processor coupled to the target designator, the target tracker, and the projectile tracker for processing target and projectile return signals and target range signals to generate an actuator command signal that is transmitted by the projectile tracker to the projectile that is used to alter the flight of the projectile; and wherein the projectile includes a projectile reference and control system that comprises:

an optical reference including polarized and unpolarized retroreflectors for reflecting the projectile-tracking signal back to the projectile tracker;

a detector that is responsive to the projectile-tracking signal provided by the projectile tracker, for detecting the actuator command signal transmitted by the projectile tracker;

a command operated actuator coupled to the detector for processing the actuator command signal and to produce a trajectory modification signal that is used to alter the flight of the projectile; and a divert assembly coupled to the command operated actuator for generating thrust that diverts the trajectory of the projectile in response to the trajectory modification signal; and wherein the optical reference is caused to nutate while the projectile flies towards the target, and wherein the tracking and guidance system initially measures roll orientation of the projectile by monitoring the nutation of the polarized return signal while the projectile is relatively close to the projectile tracker, and subsequently measures roll orientation of the projectile by monitoring the modulation of the polarized return signal from the projectile tracker when the projectile is further from the projectile tracker, wherein continued rotation of the projectile allows continued measurement of its roll orientation.

2. The system of claim 1 wherein the target tracker comprises an imaging tracker.

3. The system of claim 1 wherein the target tracker comprises a laser designator return signal tracker.

4. The system of claim 1 wherein the projectile tracker comprises a high repetition rate pulsed laser illuminator.

5. The system of claim 1 wherein the projectile tracker comprises an amplitude modulated continuous wave laser.

6. The system of claim 1 wherein the projectile comprises a spin stabilized projectile.

7. The system of claim 1 wherein the projectile comprises an aerodynamically stabilized projectile.

8. The system of claim 7 wherein target tracker provides a projectile-tracking laser beam at a first operating wavelength and wherein the projectile tracker provides a second laser beam operating at a different wavelength from the projectile-tracking laser beam, and wherein the second laser beam illuminates the polarized retroreflector disposed on the projectile, and wherein the polarization of the second laser beam is continually rotated, and wherein the roll orientation of the projectile is determined by processing the polarized return beams from the polarized and unpolarized retroreflectors.

9. The system of claim 1 wherein the tracking and guidance system further comprises an encoder for encoding the actuator command signal and wherein the projectile reference and control system further comprises a decoder disposed between the detector and the command operated actuator for decoding the encoded actuator command signal.

10. The system of claim 1 wherein the target tracker comprises a laser designator tracker that operates at a first operating wavelength and wherein the projectile tracker comprises a laser illuminator that operates at a second operating wavelength that is different from the first operating wavelength.

11. The system of claim 10 wherein the projectile tracker comprises a laser illuminator whose output energy beam is encoded.

12. The system of claim 1 wherein the command operated actuator comprises an explosive actuator that is directly ignited by a laser pulse that is focused thereon.

13. The system of claim 12 wherein the command operated actuator comprises a graded index lens that is used to focus the laser pulse thereon.

14. The system of claim 1 which comprises a phase locked loop to track the roll position of the projectile as it spins, and wherein input to the phase locked loop at short range are signals that comprise the azimuth and elevation angle of the polarized and unpolarized retroreflectors and the variation in amplitude of the polarized return signal therefrom, and at long range comprises only the polarized return signal, and wherein continuous measurement of roll position resolves ambiguity of the polarized return by locking the phase lock loop to the roll angle of the projectile at short range when nutation unambiguously defines roll position of the projectile.

15. The system of claim 1 wherein the nutation of the optical reference is resolved using a quadrant detector in the projectile tracker.

16. A guided projectile system for guiding an aerodynamically stabilized projectile to a target, said system comprising:

a tracking and guidance system comprising:

a target tracker;

a projectile tracker for providing a projectile-tracking signal and which comprises a phase locked loop to track the roll position of the aerodynamically stabilized projectile as it spins;

a target designator for designating the target using a target-tracking signal, and for providing range data indicative of the range to the target; and a processor coupled to the target designator, the target tracker, and the projectile tracker for processing target and projectile return signals and target range signals to generate an actuator command signal that is transmitted by the projectile tracker to the aerodynamically stabilized projectile that is used to alter the flight of the projectile; and wherein the aerodynamically stabilized projectile includes a projectile reference and control system that comprises:

an optical reference including polarized and unpolarized retroreflectors for reflecting the projectile-tracking signal back to the projectile tracker;

a detector that is responsive to the projectile-tracking signal provided by the projectile tracker, for detecting the actuator command signal transmitted by the projectile tracker;

a command operated actuator coupled to the detector for processing the actuator command signal and to produce a trajectory modification signal that is used to alter the flight of the aerodynamically stabilized projectile; and a divert assembly coupled to the command operated actuator for generating thrust that diverts the trajectory of the aerodynamically stabilized projectile in response to the trajectory modification signal;

and wherein input to the phase locked loop at short range are signals that comprise the azimuth and elevation angle of the polarized and unpolarized retroreflectors and the variation in amplitude of the polarized return signal therefrom, and at long range comprises only the polarized return signal, and wherein continuous measurement of roll position resolves ambiguity of the polarized return by locking the phase lock loop to the roll angle of the projectile at short range when nutation unambiguously defines roll position of the projectile.

* * * * *